United States Patent [19]

Hohn

[11] 4,084,386

[45] Apr. 18, 1978

[54] APPARATUS FOR AND A METHOD OF TUNNELLING

[75] Inventor: Walter Hohn, Lunen, Germany

[73] Assignee: Gewerkschaft Eisenhutte Westfalia, Lunen, Germany

[21] Appl. No.: 753,514

[22] Filed: Dec. 22, 1976

[30] Foreign Application Priority Data

Dec. 24, 1975 Germany ..... 2558670

[51] Int. Cl.[2] ..... E21D 9/06

[52] U.S. Cl. ..... 61/85; 61/45 R

[58] Field of Search ..... 61/85, 84, 45

[56] References Cited

U.S. PATENT DOCUMENTS

| | | | |
|---|---|---|---|
| 3,673,806 | 7/1972 | Hanig et al. | 61/45 R |
| 4,022,029 | 5/1977 | Jutte et al. | 61/85 |

FOREIGN PATENT DOCUMENTS

| | | | |
|---|---|---|---|
| 1,489,038 | 6/1967 | France | 61/85 |

*Primary Examiner*—Jacob Shapiro

*Attorney, Agent, or Firm*—Thompson, Birch, Gauthier & Samuels

[57] ABSTRACT

A drive shield of a tunnelling apparatus has elongate drive members supported and guided for longitudinal movement in a manner known per se. The drive members are connected to rear members or tails forming a rear shield and fluid concrete is introduced into a reception space within the rear shield to create a permanent lining for the tunnel. The rear members are shaped or profiled to provide recesses which are closed-off over a certain zone with the aid of covers. Reinforcing bars or the like can be inserted into the recesses to become cast into the concrete lining and means for delimiting the front end of the concrete reception space, such as a ring component, engages on the covers which form a smooth continuous bearing surface therefor.

18 Claims, 7 Drawing Figures

FIG. 1

APPARATUS FOR AND A METHOD OF TUNNELLING

BACKGROUND TO THE INVENTION

The present invention relates in general to apparatus for, and a method of driving tunnels, galleries, adits, trenches and similar excavations referred to hereinafter for convenience as tunnels. More particularly, the present invention is concerned with drive shield for tunnelling apparatus and to a method of forming a permanent lining for a tunnel.

It is known to drive tunnels with the aid of drive shields composed of a series of elongate drive members or knives supported and guided for individual displacement on a frame. Rams serve to alternately advance the drive members and the frame. It is also known to provide the individual drive members with follow-up tails which form a rear shield to support the tunnel wall between the forward drive shield and a permanent rear lining. To create the permanent lining, fluid concrete can be introduced into the rear shield and the rear shield can then form a sheath or form for the concrete. A main inner form conveniently composed of removal cylindrical parts can be spaced from the rear shield to define the radially-innermost surface of the concrete reception space. The individual parts of the inner form can then be repositioned successively as the tunnel progresses. A further wall is also provided to delimit the front end of the concrete receptive space. This further wall is usually a simple sheet or plate attached or engaged with the main inner form at its forward end and engaging on the inner surface of the rear tails to thereby seal off the reception space. It is also known to profile or shape the rear tails to create stiffness and resist flexure and in this case the further wall must be adapted to conform with such a shaping to thereby maintain its sealing effect. Despite such measures however it is quite common for the drive shield to deviate from the intended path of the tunnel and consequently the relative positions between the rear shield and the main form can vary. As a result the further wall cannot reliably seal off the concrete and the only recourse is to utilize a fresh wall for each concrete section especially adapted to the particular positional relationship between the outer sheath, i.e., the rear shield, and the main inner form. With regard to the foregoing the present invention seeks to provide an improved construction for the rear shield components and an improved method for forming the concrete lining for the tunnel.

SUMMARY OF THE INVENTION

In one aspect the invention provides a shaped rear tail member for attachment to a drive member of a drive or knife shield. The rear tail member serves to form part of a sheath outwardly defining, with other similar members, a concrete reception space. The rear tail member has a substantially planar flat or curvilinear cover, e.g., a welded-in plate which forms part of a smooth bearing surface for engagement with separate means such as a wall structure defining a front or forward limitation of the reception space. The rear tail member of the invention may have a single recess or several such recesses open towards the concrete reception space with its cover closing off this recess just over a certain zone of its length. A U-shaped cross-section is a convenient profile for the rear tail member and the member preferably has side flanges aligned, e.g., coplanar, with the cover to also form part of the aforementioned bearing surface. The means defining the front limitation of the concrete reception space may take the form of a wall structure such as an annular ring composed of segments with a polygonal or circular periphery engaging in a sliding and sealing relationship with the cover. In contrast to the known constructions special adaptation of the wall structure to the shape of the rear tail members is unnecessary. Preferably the segments of the wall structure are radially displaceable so that sealing and guiding contact with the bearing surface can be maintained even if there is deviation between the surface and a reference axis.

In known manner the wall structure engaging on the bearing surface can be re-positioned and re-used for successive sections of concreting work.

A drive shield embodying the invention may comprise elongate drive members arranged side-by-side, means for supporting and guiding the drive members for individual displacement in the driving direction, a rear tail member provided for each drive member, the rear tail members being shaped to provide recesses open at the interior and combining to form a rear shield, means, including at least part of the rear shield, for defining a concrete reception space into which fluid concrete is introduced to create a tunnel lining, a bearing surface providing at least partially by covers extending over the recesses of the tail members wherein the defining means comprises a structure forming a front wall nearest the drive members which structure engages on said bearing surface.

Preferably the rear tail members are pivoted to the drive members to enable the tail members to be radially braced against the tunnel wall to avoid subsidence. Closure devices such as plugs can be located in the recesses of the tail members to seal off forward parts thereof from the reception space. Conveniently, reinforcements such as bars, extend through these closure devices and are inserted into the recesses for casting into the concrete introduced into the reception space.

A main form defining the inner side of the reception space may allow the fluid concrete to enter the space.

The covers on the rear tail members preferably extend over a region of the length of the members somewhat greater than the shifting distance performed by the drive members.

A method of driving a tunnel utilizing a drive shield as described involves the steps of inserting reinforcement bars into the recesses, sealing off front parts of the recesses from the reception space with closure devices through which the bars extend and introducing concrete into the space to form a lining section with external axial ribs conforming to the recesses and containing the reinforcement bars.

It is desirable to make the axial ribs of each lining section terminate rearwardly of an end face thereof corresponding to the delimiting means. This can be achieved inherently by the closure devices which can be re-usable or incorporated with the bars as a subassembly. The advantage of this method of construction is that the ribs of one concrete lining section are reinforced and overlap an inner portion of a previously installed section to adjoin the ribs of the latter section thus providing an especially stable connection between the lining sections. The bars can be joined up together to extend right through the combined ribs. The reinforced ribs provide an especially strengthened lining for the tunnel and the reinforcements can be inserted quite easily from the rear during the progress of the concreting work. The closure devices also serve to position the reinforcements in the hollow recesses ready for the fluid concrete.

The invention may be understood more readily and various other features of the invention may become apparent from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
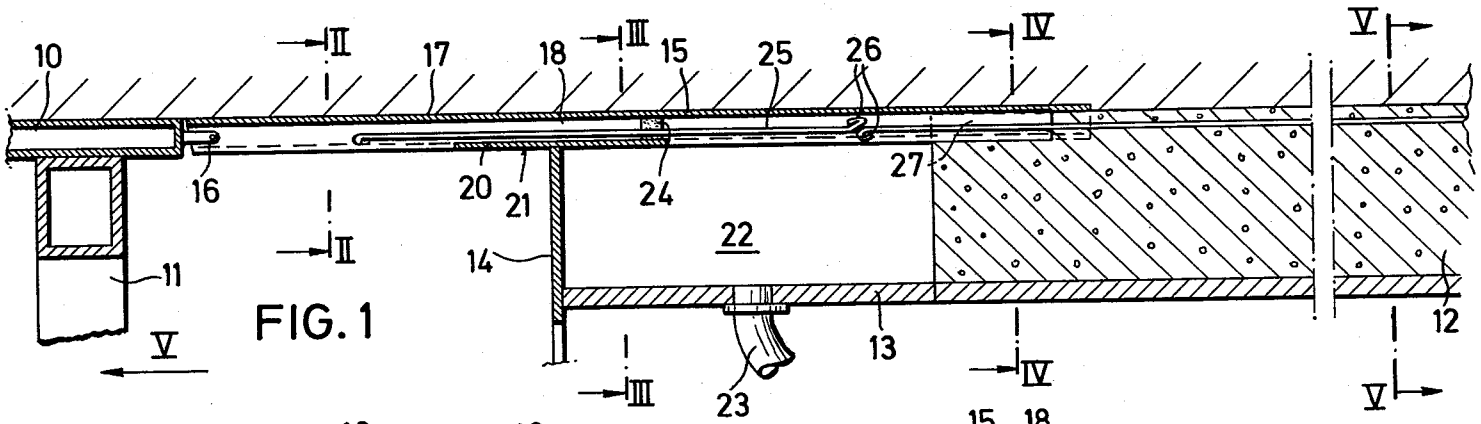
FIG. 1 is a sectional side view of part of a drive shield made in accordance with the invention.
Figure 2:
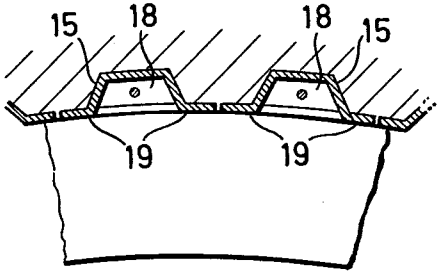
FIG. 2 is a sectional end view taken along the line II—II of FIG. 1.

Apparatus made in accordance with the invention and intended for use in tunnel driving operations employs a drive or knife shield composed, in known manner, of a series of elongate drive members or knives arranged side-by-side in parallel configuration in contact with the tunnel wall 17 at the front driving region. One of the drive members is designated by reference numeral 10 in the accompanying drawings. The drive members 10 are in the form of profiled steel plates which may be fabricated by rolling or by a welded sub-assembly. In known manner, the drive members 10 are supported and guided for longitudinal displacement (arrow V FIG. 1) by means of a frame 11. The drive members 10 are coupled to the frame 11 with the aid of hydraulic rams so that the members 10 can be thrust forwards in the direction of arrow V either individually or in groups. The driving operation involves driving the members 10 forwards in successive stages and then drawing up the frame 11 by actuating all the rams 10 together in a reverse sense. Such an operation is well known per se.

The tunnel wall 17 exposed behind the drive shield 10, 11 is supported by a lining 12 formed by casting fluid concrete in situ. As shown in FIG. 1 a reception space 22 for the fluid concrete is defined inter alia by an inner sheath or form 13 conveniently of cylindrical shape which is movable in the direction V to follow the driving progress. One or more further form sections which constitute a continuation of the form 13 can be relocated from the rear to the front as the concrete becomes self-supporting.

A front limitation or screen for the concrete reception space 22 is provided by a single or multipart wall structure in the form of a ring component 14 and locates at the front end of the form 13. At the tunnel-wall side, the concrete reception space 22 is defined by a rear shield composed of a series of rear members or tails 15 which follow-up the members 10. Each member 10 has one of the members 15 allocated to it. The member 15 can be rigidly affixed to the drive members 10 although it is preferred to connect the members 10, 15 together with the aid of pivot joints 16 with pivot axes transverse to the longitudinal axis of the shield and the tunnel. Such pivot connections permit the members 15 to be adjusted to some extent, even though only a few degrees, and the members 15 can be swivelled by adjustment means against the tunnel wall 17 to avoid subsidence.

Figure 3:
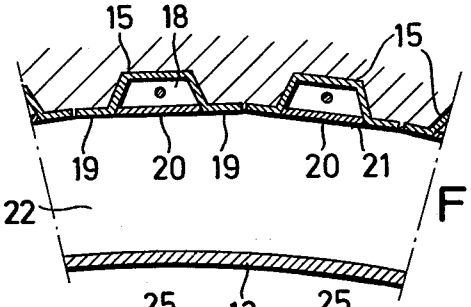
FIG. 3 is a sectional end view taken along the line III—III of FIG. 1.

As shown in FIGS. 2 to 4, and FIG. 6, the rear members 15 are shaped to provide somewhat U-shaped cross-sections with recesses or grooves 18 open towards the inside. The rear shield thus has a corrugated inner profile. Each member 15 has lateral flanges 19 extending side-by-side in aligned relationship. Over the zone where the ring component 14 is located each member 15 has a flat-plate-like smooth cover 20. Each cover 20 screens-off the recess 18 of the associated member 15 and can take the form of a simple flat metal sheet welded to the member 15 to lie co-planar with the flanges 19 as shown in FIG. 3. The flanges 19 of the members 15 and the covers 20 have inner faces which combine to form a bearing surface 21 for engaging with the peripheral surface of the ring component 14 to seal-off the space 22. As shown in FIG. 7, the ring component 14 does not have a circular periphery but rather a polygonal periphery with flat faces 14' engaging with the covers 20 and the flanges 19 of the individual rear members 15 and corresponding in width thereto. The ring component 14 may be in one-piece or assembled from several segments preferably relatively adjustable segments. The periphery of the ring component 14 can be circular if desired and this would necessitate making the flanges 19 and the covers 20 curvilinear.

The abutment between the front end of the form 13 and the radial face of the component 14 also ensures sealing of the space 22. The covers 20 extend over part of the length of their associated members 15 and thereby provide over the appropriate parts of the members 15 a box-section serving to stiffen the members 15. The length of the covers 20, i.e., axially of the members 15 is at least somewhat greater than the stroke of the rams provided for shifting the drive members 10. In this way when the drive members 10 and hence the rear members 15 are shifted up in the forward direction V adequate sliding contact is maintained between the bearing surface 21 and the periphery of the component 14.

The fluid concrete is supplied under pressure and introduced into the space 22 via at least one conduit 23 extending, for example, through the form 13. A typical concrete lining section would have a length of between 2 and 5 meters. Concrete is prevented from flowing forwardly through the recesses 18 with the air of seals or closure devices 24 (FIGS. 1 and 7) inserted into the recesses 18 and located on the covers 20. Such devices 24 can be in the form of plugs made of foamed plastic or some other material.

Before the concrete is introduced and before the component 14 is located or attached reinforcing bars 25 are inserted into the recesses 18 from the rear ends of the members 15. These bars 25 may have hooks 26 or similar attaching means permitting the newly inserted bars 25 to be connected up to the previously inserted bars 25 set in the previously formed concrete lining section and projecting forwardly thereof. The devices 24 can be fixed into the recesses 18 and provided with apertures merely permitting, i.e., accepting, the passage of the bars 25. Instead it may be preferred to utilize separate devices 24 mounted to the bars 25 as a subassembly and located in the recesses 18 when the bars 25 are inserted. The device 24 whether fixed or separate serve to support the bars 25 while the concrete is introduced and is becoming self-supporting.

Figure 4:
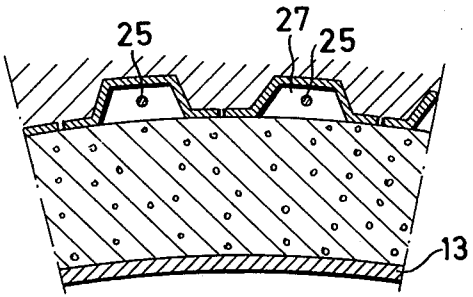
FIG. 4 is a sectional end view taken along the line IV—IV of FIG. 1.
Figure 5:
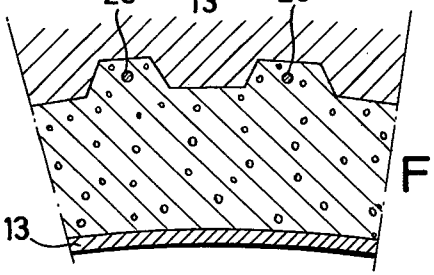
FIG. 5 is a sectional end view taken along the line VI—VI of FIG. 1.

The rear members 15 can be shifted up with their associated drive members 10 before the concrete has completely set. Thus as each member 10 is advanced in the direction V by the full stroke of its associated ram the associated rear member 15 slides with its bearing surface 21 on the component 14. The consequential gap 27 left at the tunnel wall 17 by the shifting of the rear member 15 will become filled up when the next batch of concrete is introduced (FIGS. 4 and 5).

Figure 6:
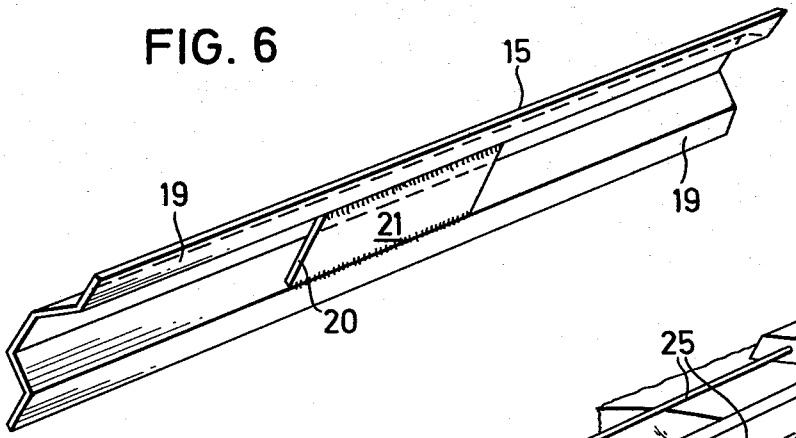
FIG. 6 is a perspective view of a component of the drive shield.
Figure 7:
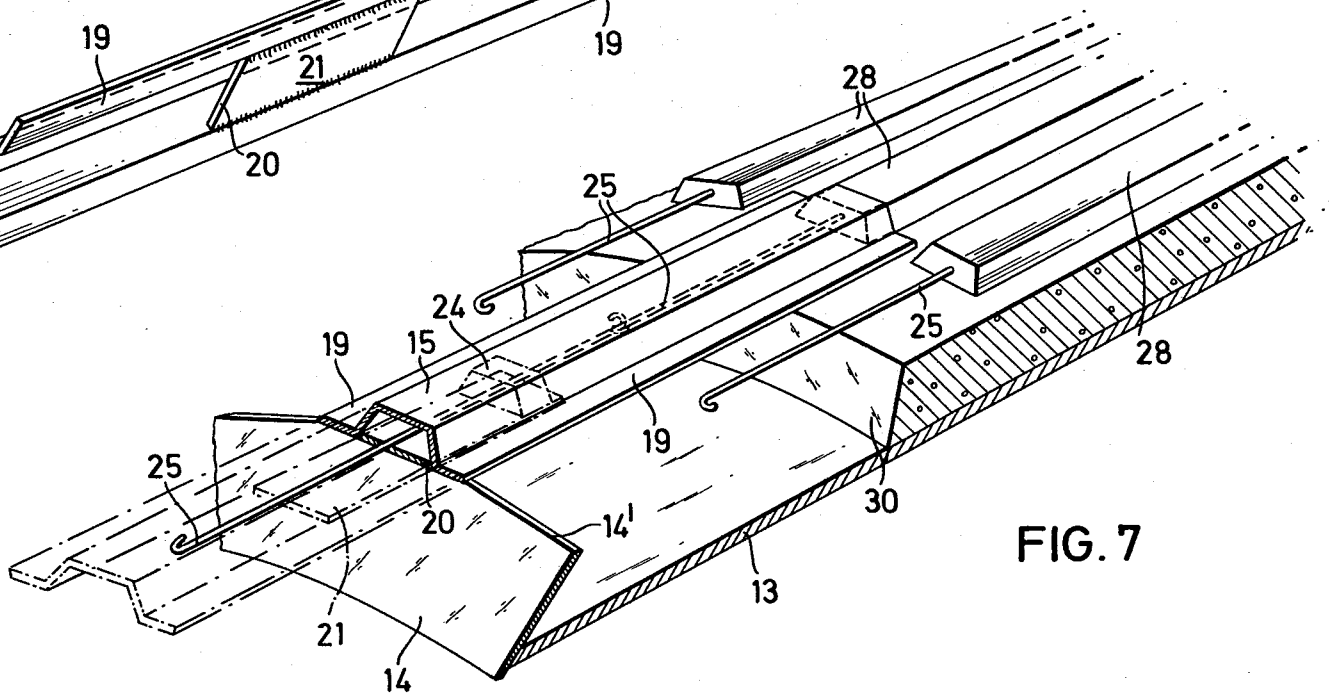
FIG. 7 is a perspective view partly in section of part of the drive shield.

As shown in FIGS. 6 and 7 the concrete lining left behind the rear shield has a series of axial ribs 28 containing the reinforcement bars 25 and corresponding to the corrugated shape provided by the recess 18 of the members 15. These ribs 28 terminate at a certain distance rearwardly beyond the front end 30 of the main concrete mass due to the presence of the devices 24. As each concreting cycle takes place after the rear shield, i.e., all the members 15, have been shifted, the ribs 28 will be continued by the new batch of concrete. The individual concrete lining sections thereby overlap with the ribs 28 to ensure firm connections between the lining sections.

When each concrete section has become sufficiently stiff the component 14 and the main form 13 can be moved up in the direction V ready for the next cycle preceded by the insertion of the bars 25 as described.

It is not necessary for the rear members 15 to have the shape as depicted since the invention can be performed by adopting other shapes for the members 15. For example each rear member 15 could have two or more recesses arranged side by side. Other modifications are also possible within the scope of the invention defined by the appended claims.

I claim:

1. A drive shield for use in tunnel driving operations; said shield comprising elongate drive members arranged side-by-side, means for supporting and guiding the drive members for individual displacement in the driving direction, a rear tail member provided for each drive member, the rear tail members being shaped to provide recesses open at the interior and combining to form a rear shield, means, including at least part of the rear shield, for defining a concrete reception space into which fluid concrete is introduced to create a tunnel lining, a bearing surface provided at least partially by covers extending over the recesses of the tail members wherein the defining means comprises a structure forming a front wall nearest the drive members which structure engages on said bearing surface.

2. A drive shield according to claim 1, wherein the drive members and rear tail members are pivotably interconnected.

3. A drive shield according to claim 1, wherein the rear tail members have their covers extending over a portion of their length.

4. A drive shield according to claim 1, wherein the defining means further comprises an inner form engaging at one end on said front wall.

5. A drive shield according to claim 1 and further comprising means for admitting fluid concrete into said reception space.

6. A drive shield according to claim 1, wherein the rear tail members have lateral flanges extending side-by-side and aligned with their covers.

7. A drive shield according to claim 1, wherein the covers are flat plates and the front wall has a polygonal edge with individual faces in sliding and sealing engagement with the respective covers.

8. A drive shield according to claim 1, wherein the covers are curvilinear plates and the front wall has a circular edge in sliding and sealing engagement with the covers.

9. A drive shield according to claim 1, wherein closure devices are provided for insertion into the recesses to seal off parts of the recesses from the reception space.

10. A drive shield according to claim 9, wherein reinforcement bars extend through the closure devices whereby parts of the bars become embedded in the concrete introduced into said reception space.

11. In a method of driving a tunnel utilizing a drive shield composed of a plurality of movable drive members forming a drive shield and connected to rear tail members shaped to provide recesses open at the interior and combining to form a rear shield outwardly defining a concrete reception space communicating with the recesses and delimited at the front end by means engaging on a bearing surface composed of covers extending over the recesses of the rear tail members; the improvement comprising inserting reinforcement bars into the recesses, sealing off front parts of the recesses from the reception space with closure devices through which the bars extend and introducing concrete into the space to form a lining section with external axial ribs conforming to the recesses and containing the reinforcement bars.

12. A method according to claim 11, wherein the reinforcement bars are joined to bars previously inserted.

13. A method according to claim 11, wherein the axial ribs of each lining section terminate rearwardly of an end face thereof corresponding to the delimiting means so that the ribs of one section adjoin the ribs of the previously constructed section and overlap an inner portion of the latter section.

14. In or for a drive shield for use in tunnel driving operations; a shaped hollow rear tail member for forming part of an outer defining sheath of a concrete reception space, said rear tail member having at least one recess open towards the concrete reception space, a substantially planar cover closing off the recess over a zone and forming part of a bearing surface for engagement with separate means defining a front limitation of the reception space, and a closure device having an aperture for receiving a reinforcement member during use, the closure device being locatable within the recess to seal off part of the recess from the reception space.

15. In or for a drive shield for use in tunnel driving operations; a shaped hollow rear tail member for forming part of an outer defining sheath of a concrete reception space, said rear tail member having at least one recess open towards the concrete reception space, a substantially planar cover closing off the recess over a zone and forming part of a bearing surface for engagement with separate means defining a front limitation of the reception space, and a closure device having a reinforcement member extending therethrough, the closure device and the reinforcement member being together receivable in the recess, the closure device serving to seal off part of the recess from the reception space.

16. A member according to claim 14, wherein the recess is generally U-shaped and there are side flanges aligned with the cover to combine therewith in forming said part of a bearing surface.

17. A member according to claim 14, wherein the cover is in the form of a flat plate.

18. A member according to claim 14, wherein the cover is in the form of a curvilinear plate.

* * * * *